US006015101A

United States Patent [19]

Williamson et al.

[11] Patent Number: 6,015,101

[45] Date of Patent: Jan. 18, 2000

[54] BURNER SYSTEM

[75] Inventors: Mark Williamson, Mobberley; Derek Davies, Poynton, both of United Kingdom

[73] Assignee: APV UK Ltd., United Kingdom

[21] Appl. No.: 08/866,145

[22] Filed: May 30, 1997

Related U.S. Application Data

[63] Continuation of application No. 08/535,231, filed as application No. PCT/GB94/00969, May 5, 1994, abandoned.

[30] Foreign Application Priority Data

May 6, 1993 [GB] United Kingdom ..... 9309344

[51] Int. Cl.[7] ..... B05B 1/32

[52] U.S. Cl. ..... 239/455; 239/456; 239/562; 239/566; 239/554; 239/552; 239/553.5

[58] Field of Search ..... 239/554, 553.3, 239/553.5, 552, 456, 562, 566

[56] References Cited

U.S. PATENT DOCUMENTS 1,642,153 9/1927 Kemp .
2,807,320 9/1957 Wilderman ..... 239/562
2,869,630 1/1959 Flynn .
3,334,820 8/1967 Flynn ..... 239/562

FOREIGN PATENT DOCUMENTS 338806 11/1930 United Kingdom .
961737 4/1964 United Kingdom .
2145216 3/1985 United Kingdom .

*Primary Examiner*—Carroll B. Dority
*Attorney, Agent, or Firm*—Loeb & Loeb LLP; Michael J. Ram

[57] ABSTRACT

A gas burner system which can be used in a conveyor-type oven has a burner tube (4) extending across the conveyor. Gas is burnt through a slot (8) along the tube to give a ribbon flame. The tube (4) is divided into separate compartments (15–19) which connect with different lengths of the slot (8). Combustible gas is fed under independent control to the different compartments (15–19), and the slot lengths are adjustable. The slot lengths consist of short edge-region slots and multiple, longer central region slots.

14 Claims, 4 Drawing Sheets

BURNER SYSTEM

This is a continuation of application Ser. No. 08/535,231, filed Oct. 27, 1995, now abandoned, which is the National Stage filing in the U.S. of PCT/GB94/00969, filed May 5, 1994, which claims priority of Great Britain application 9309344.1, filed May 6, 1993.

TECHNICAL FIELD

This invention relates to a gas burner system for use in heating apparatus.

BACKGROUND ART

Ovens of the kind having a conveyor running beneath overhead transverse gas burners are widely used for continuous production of bread, pies, pizzas, biscuits and other baked foodstuffs.

The gas burners comprise tubes with side slots. Gas fed from one end burns, as a ribbon flame, along the side slots. In the case where a uniform flame is used along the length of the tube it is difficult to attain uniformity of heating since the edges of the conveyor tend to have different thermal transfer characteristics compared with the central region, typically giving greater heating at the edges.

Lack of uniformity is disadvantageous because this means that foodstuffs will not be equally baked across the conveyor. In an attempt to overcome this problem it is known to use a burner tube with two edge slots and one central slot all of equal length and communicating with separate internal compartments fed with gas via respective feed pipes and control valves. In this way it is possible to produce different flame sizes, and hence different heat intensities, at the edges compared with the central region. However, this does not provide a total solution to the problem because the change in thermal transfer characteristics across the conveyor will not normally occur in three distinct regions corresponding to the positioning of the three burner tube slots.

A further problem arises in connection with the attainment of high thermal output along the length of the three-compartment gas burner. The three compartments are fed with air and gas mixed with a Venturi injector. The ratio of the air to gas, and the flow rate of the mixture determine the thermal output per unit length of the gas burner slots. In the context of the short length slots of the three compartments, an inconvenient limitation may be imposed on the maximum flow rate and hence the maximum thermal output due to destabilisation of the flame. As the flow rate is increased by increasing mixture pressure and/or reducing slot width, there is an increasing tendency for the flame to 'blow away' or otherwise destabilise. By way of example, whereas a 90,000 BTU/hr (95,000 KJoules/hr output may be attainable with a single zone 39 inch (99 cm) burner, it may be necessary to turn down the flow rate with a three-compartment burner of the same overall length so that a maximum output of only 45,000 BTU/hr (47,500 KJ/hr) is attainable.

Three-compartment burners may require complex and costly control systems for switching off the flames e.g. during gaps and product change-overs.

DISCLOSURE OF THE INVENTION

One object of the present invention is to provide a gas burner system for use in heating apparatus whereby a desired distribution of heating intensity can be more readily achieved along a heating region.

According to one aspect of the invention therefore there is provided a gas burner system for use in heating apparatus along a heating region, said system comprising a tube extending along said region, a plurality of outlet apertures for burning gas extending along said tube, said tube being separated into a plurality of compartments communicating respectively with the apertures, and feed conduits for connecting said compartments to a source of combustible gas, characterised in that the apertures comprise two edge region apertures respectively at the end portions of the tube, and one or more central region apertures in the central portion of the tube between said end portions, the length of each edge region aperture being a minor proportion of the length of the central portion. Preferably there are a plurality of central region apertures.

With this arrangement, it is possible more readily to attain a desired distribution of heating intensity along the heating region to match changes in thermal transfer characteristics.

Preferably combustion is independently adjustable, particularly by adjustment of flow rate and/or mixing of gas and air, for each said compartment. Thus, there may be a respective mixer and also respective control valves for controlling supply and mixing of gas and air for each said compartment. Each mixer may be a Venturi injector of known kind and for each compartment there may be separate gas and air valves of a screw kind or any other suitable kind, such valves being physically integrated with or separate from the mixer.

Preferably also, the length of at least some of the outlet apertures (and preferably all) is adjustable. Thus, the tube may be separated into said compartments by means of barriers, said barriers being movable along the tube in relation to a continuous aperture slot so as to shorten or lengthen the compartments and hence the lengths of the aperture slot in communication therewith.

Preferably the burner tube has a continuous aperture slot (or equivalent as mentioned below) along one side, and a plurality of barrier walls are mounted within the tube on an elongate supporting member so as to be positionally adjustable along the tube. In one embodiment the elongate supporting member comprises an inner tube and the barriers comprise collars between the outer surface of the inner tube and the inner surface of the outer tube.

The tube may also be of circular cross-section, except for the outlet aperture slot which preferably is bounded by outwardly projecting side walls.

The feed conduits may be connected to said compartments via chambers in the inner tube.

Supply of combustible gas to the compartments may also be achieved via feed apertures provided in the tube at positions which are spaced longitudinally along the tube.

In this case an elongate feed block or chamber may run along the tube, e.g. along the opposite side of the tube to the continuous outlet slot therein, said feed conduits comprising bores or pipes which run through the block or chamber and connect at one end with the feed apertures and at the other end with gas/air mixers and/or control valves e.g. in a manifold structure on the end of the block or chamber.

Alternatively, the burner tube may have an internal pipe with an outlet, such as a continuous slot, therealong, aligned with the outlet slot in the tube, and with feed apertures spaced along and also circumferentially around the pipe with which the feed conduits connect.

In this case, the feed conduits may comprise channels running along the inner surface of the burner tube and which are aligned respectively with the feed apertures in the inner pipe. These channels may connect with gas/air mixers and/or control valves e.g. in a manifold structure at one end of the outer burner tube.

In a particularly preferred arrangement there are three central region burner apertures between the two edge region apertures. The edge region apertures may be much shorter than the central region apertures e.g. each edge region aperture constituting a minor proportion of the length of a central region aperture and preferably constituting about 10% to 12½% of the overall length of the burner apertures. Preferably also the burner tube length is greater than the length of the heating region.

With regard to the above mentioned continuous burner tube slot, this constitutes a continuous slot in the sense that it acts to produce in use a continuous ribbon flame along the slot. Thus, the continuous slot may be defined by a continuously free elongate opening, or alternatively by multiple closely positioned openings. In a preferred embodiment the continuous slot is a stepped slot having inner and outer portions, the outer portion being wider than the inner portion.

In a particularly preferred embodiment the slot contains a flow dispersing structure. In this respect it is known to provide a simple flow dispersing structure in a burner tube slot comprising an inserted strip bent from side to side in wave formation to define a series of holes between the strip and the side walls of the slot. However, the holes are relatively large and this limits the degree of flow dispersion. Flow dispersion facilitates power output in that it enables a stable flame to be maintained at higher rates of gas flow, and hence permits higher levels of power output. Without flow dispersion, the flame will tend to blow off as the flow rate is increased.

Most preferably, the flow dispersing structure comprises two or more side by side strips bent from side to side to define a series of gas flow holes therebetween.

With this arrangement, a relatively high degree of flow dispersion can be readily attained.

The strips may be bent sinuously with the wave formations of adjoining strips out of phase. Other arrangements involving in-phase sinuous strips, and/or other shapes of strips or interposed straight strips or the like can also be used.

The gas burner system of the invention may be used in heating equipment of the kind having a conveyor band running between transverse gas burners located above and/or below the band.

According to a second aspect of the present invention there is provided a gas burner system for use in heating apparatus along a heating region, said system comprising a tube extending along said region, a plurality of outlet apertures for burning gas extending along said tube, said tube being separated into a plurality of compartments communicating respectively with the apertures, and feed conduits for connecting said compartments to a source of combustible gas, characterised in that the apertures comprise two edge region apertures respectively at the end portions of the tube, and one or more central region apertures in the central portion of the tube between said end portions, flow of said combustible gas through each said aperture being independently adjustable.

BRIEF DESCRIPTION OF THE DRAWINGS

The invention will now be described further by way of example only and with reference to the accompanying drawings in which.

DESCRIPTION OF THE PREFERRED EMBODIMENTS

Figure 1:
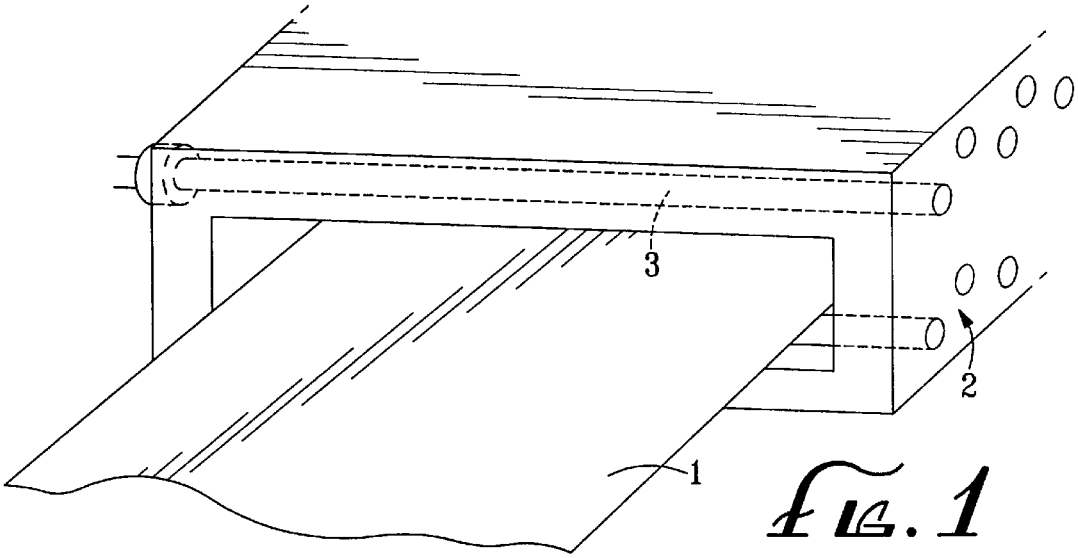
FIG. 1 is a schematic perspective view of an oven incorporating one form of a burner system according to the invention.

Referring to FIGS. 1–4, an oven has a conveyor 1 running horizontally through a tunnel 2 having a series of overhead gas burners 3 extending transversely across the conveyor 1.

Each burner 3 consists of a burner tube 4 which is a cast or extruded section comprising an elongate tubular body part 5 of essentially circular cross-section with a radially outwardly projecting ridge 6 extending the entire length of the body part parallel to its axis. The section has a central circular bore 7 and a stepped slot 8 is milled through the ridge 6 to meet the bore 7.

At one end the body part 5 is flanged and attached to a distributor body 9 yet to be described. There is a circular cross-section inner tube 10 extending axially along the bore 7. This tube 10 is spaced from the inner surface of the bore 7. At one end it is fixed to the distributor body 9. At the other end it projects beyond the end of the outer tube 4 and is fixed to a mounting member 11. The inner tube 10 has mounted thereon six collars 12 each of which fits in close contact with the outer surface of the inner tube 10 and the inner surface of the bore 7 and which has a radially projecting flange 13 which fits in close contact with the inner surface of the inner portion 14 of the stepped slot 8.

At each end portion of the tube 10 there are two closely spaced flanged collars 12. In the central region of the tube 10 there are two further flanged collars 12 which are more widely spaced. The collars 12 are positionally adjustable along the inner tube 10.

Between each pair of adjacent collars 12 a respective annular compartment 15–19 is defined between the inner surface of the bore 7 and the outer surface of the inner tube 10, giving five compartments in total: two equal length short end compartments 15, 19, and three equal length longer central compartments 16–18. The interior of the inner tube 10 is divided into five chambers 20–24 by circular discs 25 which are sealed relative to the inner surface of the inner tube 10. The chambers 20–24 are in communication with the respective compartments 15–19 through openings 26 in the wall of the inner tube 10. As shown, the discs 25 may be aligned radially with the respective collars 12.

Within the inner tube 10 five gas feed pipes 27 extend from the distributor body 9 parallel to the tube axis. The pipes 27 terminate in and open to the respective chambers 20–24. The pipes 27 extend through and are sealed relative to the peripheries of holes in the discs 25.

Figure 10:
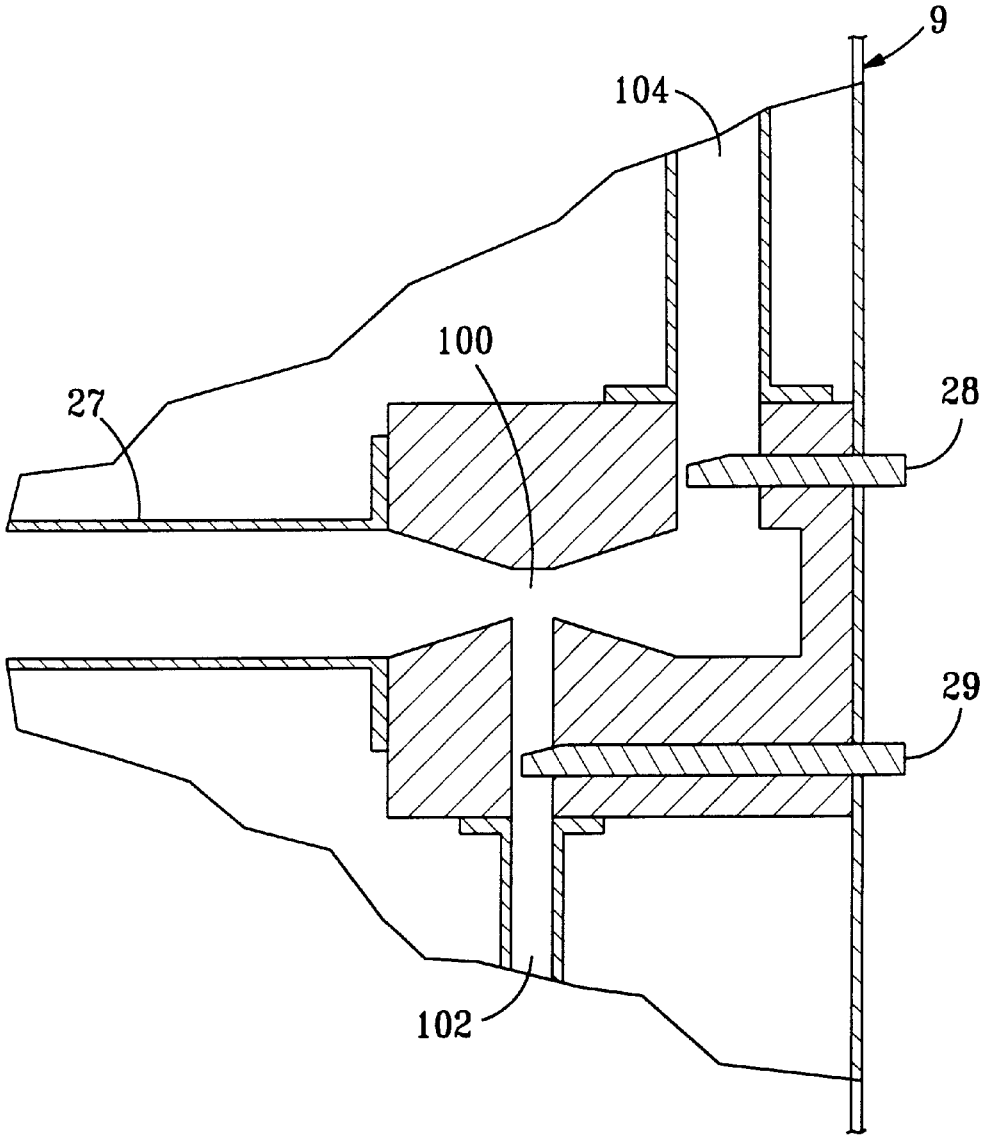
FIG. 10 is a cutaway view of the circled portion of FIG. 2 and FIG. 4 showing the interior portion of the distributor body.

The pipes 27 are connected respectively to five mixers 100 of the Venturi injector kind within the distributor body 9. The mixers 100 are connected via valves 28, 29 to a source of combustible gas 102 and to a source of compressed air 104. The valves 28,29 have adjustable screws so that the flow rates and relative proportions of gas and air fed to the mixer can be independently adjusted for each pipe. One of said mixers 100 is shown in FIG. 10. FIG. 10 is an enlarged cutaway view of the circled portion 106 of FIGS. 2 and 4.

Figure 5:
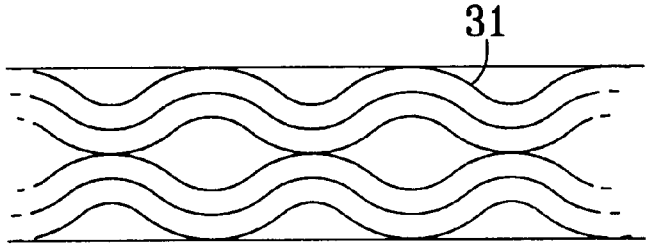
FIGS. 5 & 6 are diagrammatic plan views of alternative flow distributing structure.
Figure 6:
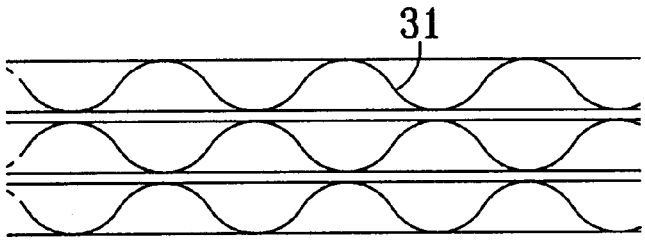

Within the outermost, wider part 30 of the stepped slot 8 there is fixed a flow distributing structure 31 in the form of one or more side-by-side crimped metal ribbons having a sinuous shape as shown in FIG. 5 or FIG. 6 of the drawings.

The entire burner tube 3 extends across and beyond the edges of the oven conveyor 1 with the slot 8 directed downwardly. In use, a ribbon flame is produced along the portions of the slot 8 corresponding to the lengths of the annular compartments 15–19. By pre-setting the mixer valve screws 28, 29 and also by pre-setting the positions of the flanged collars 12 on the inner tube 10, and hence the lengths of the compartments 15–19, and as a result the length of the outlet apertures therebetween, flames of desired intensity (vertical height) and length (horizontally across the conveyor) can be attained for each of the five zones corresponding to the five compartments 15–19. A desired distribution of heat can therefore be readily maintained. In particular it can be possible to attain uniform heating across the entire width of the conveyor 1 despite the different thermal transfer properties of the edge regions compared with the central regions.

Typically the lengths of the two short end compartments 15, 19 may be each say 10% to 12½% of the overall flame length. Due to the use of a burner tube 3 which extends beyond the conveyor edges, it can be ensured that the two short end compartments 15, 19 are aligned with such edges or otherwise positioned in relation thereto as desired.

By appropriate selection of the flow distributing structure 31, it is possible to sustain high intensity flames without blow-out occurring. High levels of thermal output can be attained in a stable, sustainable manner, even along the short slot lengths, due to the degree of control which can be exercised for each slot length independently using the respective mixer value screws 28, 29 and by adjustment of the positions of the collars 12 defining the slot lengths.

Moreover, control is achieved with particularly simple, convenient and inexpensive control mechanisms. Adjustments and control operations can be readily effected as and when desired e.g. to set parameters during commissioning, to change parameters to accommodate different products, and to switch flames on and off during gaps and product change over.

Figure 8:
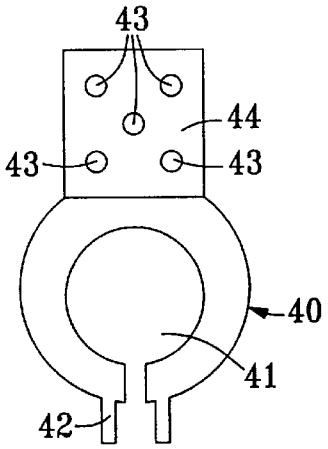
FIGS. 7 & 8 are views corresponding to FIG. 3 of alternative embodiments of the burner system.
Figure 7:
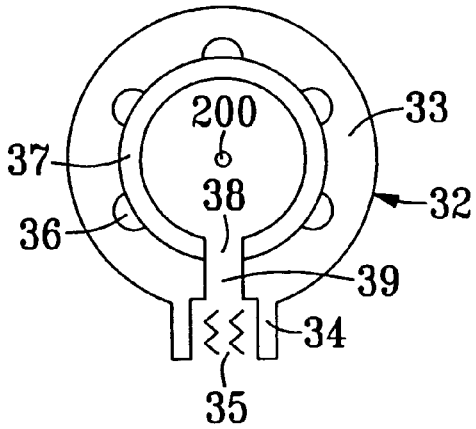

Referring now to FIGS. 7, 8, two alternative embodiments are shown. The alternative embodiment of FIG. 7 has a burner tube 32 with a circular section body part 33 and a stepped slotted flange 34 along one side which contains a flow distributing structure 35 (similar to that described in the first embodiment).

The inner bore of the tube 32 is circular with five radially outwardly projecting elongate recesses defining channels 36. A circular section inner tube 37 fits closely within the bore and closes the channels 36. This tube 37 has a slot 38 along its length which is aligned with the stepped slot 39 in the flange 34.

The tube 37 also has five short slots (not shown) at different positions along its length and also at different circumferential positions aligned respectively with the different channels 36.

Within the tube 37 there is an axial bar 200 supporting six flanged discs which separate the tube 32 into five chambers. At one end the channels 36 and the tube 37 are sealed by an end plate. At the other end the tube 37 is sealed by a distributor body like that of the first embodiment and the channels 36 are connected via respective mixer valves to a source of combustible gas and a source of compressed air.

In use, gas is fed along the channels 36 and into the respective compartments through the short slots. By adjustment of the positions of the flanged discs, and the settings of the valves, a desired distribution of ribbon flames can be attained in like manner to the first embodiment.

The embodiment of FIG. 8, like the preceding embodiments, uses a burner tube 40 with an inner bore 41 connecting with a stepped slotted flange 42 containing a flow distributing structure. The bore 41 is divided into five chambers by means of axially positionally adjustable flanged discs on an axial bar 200, similar to the arrangement of FIG. 7. Gas/air mixture is fed to the chambers from a distributor body of the kind described above by means of ducts or pipes 43 running along an elongate block or housing 44 attached to an outer flat face of the tube 40 opposite to the slotted flange 42. The ducts or pipes 43 communicate with the chambers through holes in the outer wall of the tube 40. Perforated circular discs may be provided on the axial bar 200 between the flanged discs to assist location of the bar.

Figure 9:
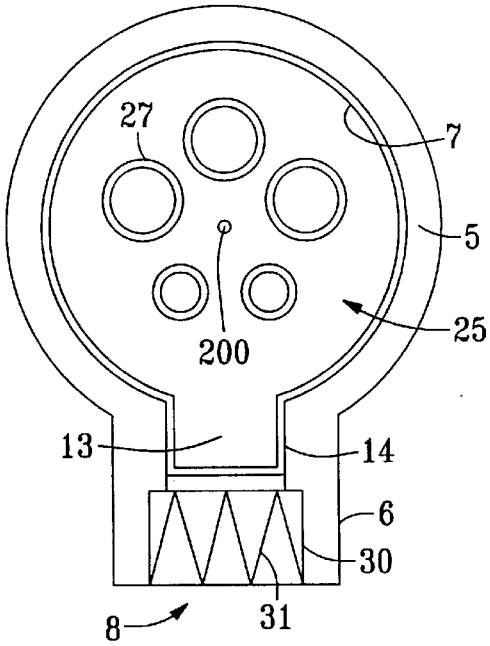
FIG. 9 is a view corresponding to FIG. 3 of a yet further embodiment.
Figure 2:
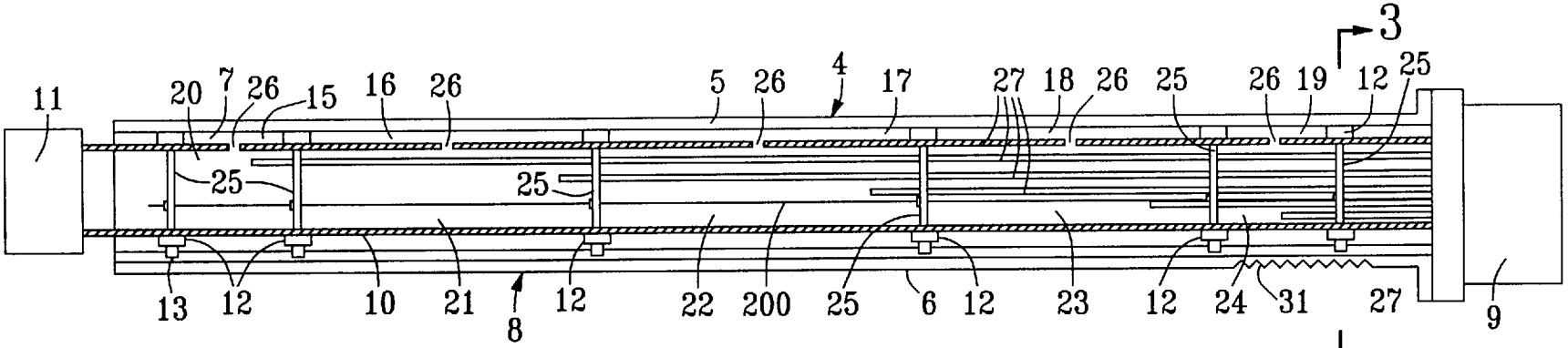
FIG. 2 is a diagrammatic longitudinal sectional view of the burner system.
Figure 4:
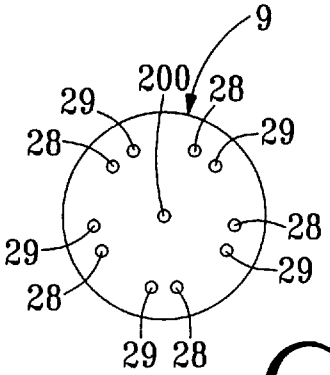
FIG. 4 is an end view from the right of FIG. 2.
Figure 3:
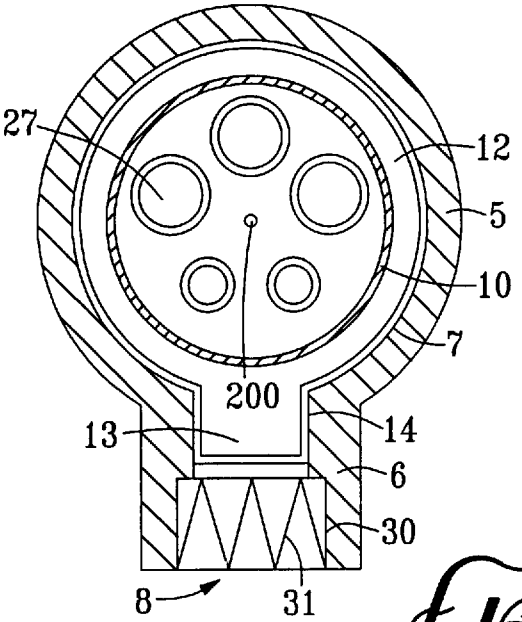
FIG. 3 is a transverse sectional view on the line 3—3 of FIG. 2, to a larger scale.

With the embodiment of FIG. 9, the distributor tube 10 of FIGS. 2 & 3 is omitted but other components are essentially the same and the same reference numerals are therefore used. In effect the plates 25 are integrated with the collars 12 of FIGS. 2 & 3 to form the plates 25 of FIG. 9.

With the burners described above efficient, uniform heating can be readily achieved.

It is of course to be understood that the invention is not intended to be restricted to the details of the above embodiments which are described by way of example only.

We claim:

1. A gas burner system for use in a heating apparatus along a heating region, said system comprising an outer tube extending along said region, said outer tube having first and second end portions, a central portion between said end portions, a continuous aperture slot extending along said outer tube providing an outlet for burning gas, a plurality of barriers within said outer tube separating said outer tube into a plurality of separate compartments communicating respectively with separate lengths of the said slot, said plurality of barriers mounted within the outer tube on an elongate supporting member so as to be positionally adjustable longitudinally of the outer tube and feed conduits providing a connection between said compartments and a source of combustible gas wherein the said slot lengths comprise two edge region slot lengths respectively at the said end portions of the outer tube, and one or more central region slot lengths in the said central portion of the outer tube, each said edge region slot length being a minor proportion of the length of the said central portion of the outer tube, and wherein at least one of the said barriers is moveable longitudinally of the outer tube so as to be positionally adjustable thereby to shorten or lengthen the compartments separated thereby and hence to shorten or lengthen the slot lengths in communication with said compartments.

2. A system according to claim 1 wherein there is a plurality of said central region slot lengths, each of which has a length greater than the length of each said edge region slot lengths.

3. A system according to claim 1 further including means to independently adjust the flow of combustible gas to each said separate compartment.

4. A system according to claim 3 characterised in that there is a respective mixer and gas and air control valves for controlling supply of gas/air mixture for each said compartment.

5. A system according to claim 4 wherein each mixer is of the Venturi injector kind.

6. A system according to claim 1 wherein the elongate supporting member comprises an inner tube and the barriers comprise collars between the outer surface of the inner tube and the inner surface of the outer tube.

7. A system according to claim 6 wherein the feed conduits deliver gas into a chamber, said chamber being a space surrounded by said inner tube and being connected to said compartments via openings through the wall of the inner tube.

8. A system according to claim 1 wherein the continuous slot is a stepped slot having inner and outer portion, the outer portion being wider than the inner portion.

9. A system according to claim 2 wherein there are three said central region slot lengths between the said two edge region slot lengths.

10. A system according to claim 2 wherein each said edge region slot length constitutes a minor proportion of the length of each said central region slot lengths.

11. A system according to claim 1 wherein the slot contains a flow dispersing structure.

12. A system according to claim 11 wherein the flow dispersing structure comprises two or more side-by-side strips bent from side-to-side to defined a series of gas flow holes therebetween.

13. A gas burner system for use in a heating apparatus along a heating region, said system comprising an outer tube extending along said region, said outer tube having first and second end portions, a central portion between said end portions, a continuous aperture slot extending along said outer tube providing an outlet for burning gas, a plurality of barriers within said outer tube separating said outer tube into a plurality of separate compartments communicating respectively with separate lengths of the said slot, said barriers being moveably mounted within the outer tube on an inner tube so as to be positionally adjustable longitudinally of the outer tube and comprising collars between the outer surface of the inner tube and the inner surface of the outer tube, and feed conduits providing a connection between said compartments and a source of combustible gas wherein the said slot lengths comprise two edge region slot lengths respectively at the said end portions of the outer tube, and one or more central region slot lengths in the said central portion of the outer tube, each said edge region slot length begin a minor proportion of the length of the said central portion of the outer tube, and wherein at least one of the said barriers is moveable longitudinally of the outer tube so as to be positionally adjustable thereby to shorten or lengthen the compartments separated thereby and hence to shorten or lengthen the slot lengths in communication with said compartments.

14. A gas burner system for use in a heating apparatus along a heating region, said system comprising an outer tube extending along said region, said outer tube having first and second end portions, a central portion between said end portions, a continuous aperture slot extending along said outer tube providing an outlet for burning gas, a plurality of barriers within said outer tube separating said outer tube into a plurality of separate compartments communicating respectively with separate lengths of the said slot, and feed conduits providing a connection between said compartments and a source of combustible gas wherein the said slot lengths comprise two edge region slot lengths respectively at the said end portions of the outer tube, and one or more central region slot lengths in the said central portion of the outer tube, each said edge region slot length being a minor proportion of the length of the said central portion of the outer tube, and wherein at least one of the said barriers is moveable longitudinally of the outer tube so as to be positionally adjustable thereby to shorten or lengthen the compartments separated thereby and hence to shorten or lengthen the slot lengths in communication with said compartments, the system further including means to independently adjust the flow of combustible gas to each said separate compartment characterised in that there are respective mixer and gas and air control valves for controlling supply of gas/air mixture for each said compartment.

* * * * *